US005610583A

United States Patent [19]

Drebika et al.

[11] Patent Number: 5,610,583

[45] Date of Patent: Mar. 11, 1997

[54] INTRUSION WARNING SYSTEM

[75] Inventors: Moataz Drebika, Santa Clara; Glenn A. Brown, Gilroy, both of Calif.

[73] Assignee: Stellar Systems, Inc., Santa Clara, Calif.

[21] Appl. No.: 763,168

[22] Filed: Sep. 20, 1991

Related U.S. Application Data

[63] Continuation-in-part of Ser. No. 669,430, Mar. 15, 1991, abandoned.

[51] Int. Cl.[6] ..... G08B 13/00

[52] U.S. Cl. ..... 340/566; 340/568

[58] Field of Search ..... 340/566, 568, 340/691, 522

[56] References Cited

U.S. PATENT DOCUMENTS

| | | | |
|---|---|---|---|
| 4,206,451 | 6/1980 | Kurschner | 340/522 |
| 4,365,239 | 12/1982 | Mongeon | 340/566 |
| 4,760,382 | 7/1988 | Faulkner | 340/568 |
| 4,785,291 | 11/1988 | Hawthorne | 340/691 |

*Primary Examiner*—Hezron E. Williams
*Assistant Examiner*—Christine K. Oda

[57] ABSTRACT

An intrusion warning system for protecting a partition, for example, a wall, ceiling, window, fenced cage, against intrusion by cutting through and/or climbing over. A vibration detector is mounted on the partition and the partition vibration detected by sensing the electric signal generated by the detector. The sensed electric signal is filtered, AM detected, shaped and processed to determine if an intrusion type event has occurred. Since research has determined that the materials composing a partition cause the vibration frequency induced into the detector to vary considerably, the system has a plurality of band filters to allow selection of the band to best monitor the partition for a given application. The system supports this selection with a built in display for the input level through an input amplifier and filters for the frequency band selected. A given stimulus to the detector thus can be analyzed for each band and the band providing the highest output selected. This band selection capability permits moving the signal band into a region of lower noise if a particular partition often vibrates at a given frequency from a known non-intrusive source. A step switch, having equal fixed increment of gain positions, is provided to set the pre-amplification of the detector produced signal. Thus an appropriate level can be set for the particular partition being monitored and the flexing thereof during a threat situation, and the system can be set up for given types of partitions without special equipment for gain setting determination.

10 Claims, 2 Drawing Sheets

INTRUSION WARNING SYSTEM

CROSS-REFERENCE TO RELATED APPLICATION

This application is a Continuation-In-Part of Applicants' U.S. patent application Ser. No. 07/669,430, filed Mar. 15th, 1991, now abandoned.

BACKGROUND OF THE INVENTION

The present invention relates to a warning or alarm system for protecting a structure against intrusion by breaking or cutting through, or climbing over partitions, or walls around or within a structure. More particularly, the present invention relates to such a system wherein a vibration sensitive detector, particularly a shielded electrical cable which produces an electrical signal due to the minute flexing of the cable caused by vibrations, is attached to the partition, and the vibrations produced when an attempted intrusion occurs are detected and processed to provide an alarm to indicate the attempted intrusion and particularly whether a cut or break-through (short term event) type intrusion or a climb over (sustained activity) type of intrusion is being attempted. A system of the above general type is disclosed in commonly assigned U.S. Pat. No. 4,365,239, issued Dec. 11th, 1982 to R. Mongeon.

When an insulated electrical cable is flexed, or when pressure is applied thereto, the resulting stress produced in the previously uncharged dielectric material of the cable by the movement results, due to the triboelectric effect, in the generation of a very small electric signal which may be sensed with appropriate sensing circuitry. When such a cable is attached to a partition, or a fence, minute flexing of the cable due to vibration of the partition results in the generation of an electric signal corresponding to these vibrations. However, electric signals will be produced both by vibrations, and hence electrical cable vibrations, which are desired to be detected, i.e., vibrations caused by attempted intrusions, as well as by vibrations which are not desired to be detected, i.e. vibrations from extraneous sources, such as air conditioners, nearby carts, or normal activities in adjacent rooms or areas, etc. Since the detection of these extraneous source caused signals could lead to false alarms, special signal processing is required in order to distinguish signals originating from intrusion related vibrations from signals originating from extraneous source related vibrations.

In order to provide adequate protection for a wall or other partition, it is desired to know whether an intruder is attempting to break or cut through the partition or is attempting to climb over same. In general, the signals resulting from attempts to break, or cut through a partition are of short duration, are abrupt, and are generally repeated a number of times within a predetermined short period of time. On the other hand, signals corresponding to attempts to climb a partition, drill through it, or pressure a collapse, generally have longer duration and a lower base frequency-than cut-through types of vibration signals and persist for a longer period of time.

Research has determined that the different materials comprising a partition vary considerably in the frequency of the vibrations induced onto the vibration detector, i.e., the cable. Moreover, as indicated above, the frequency of the vibrations for a given partition may differ greatly and over a relatively wide frequency band depending on the type of intrusion. In view of the low level of the input signals, this can result in difficulty in differentiating the vibrations from background noise, particularly if a partition is generally vibrating at a given frequency for a known and non-intrusive source, resulting either in non-detection of the actual intrusion induced input signal or a false alarm due to an extraneous vibration source. To overcome this detection problem it is often necessary to, in effect, customize a particular system at the factory for a particular type partition or installation after taking measurements with special equipment at the site of the system installation to determine an optimum operating band width. Such, of course, is rather expensive and time consuming.

SUMMARY OF THE INVENTION

It is a primary object of the present invention to provide an improved system for protecting a structure or area against intrusion utilizing the electric signal produced by the flexure of a shielded electrical cable or other type vibration detector attached to the structure or a partition defining an area, wherein the susceptibility of false alarms due to extraneous non-intrusion related signals is reduced, and wherein an alarm is produced indicating an attempt to intrude is occurring.

It is a further object of the present invention to provide a system of the above type which can effectively be adjusted and set in the field for different types of partition materials and surrounding conditions.

To achieve the above objects according to the present invention, an apparatus for detecting intrusion of a partition is provided which generally comprises the following features: a detector, attached to a partition to be protected, for detecting vibrations of the partition and for providing a signal corresponding thereto; a first circuit for receiving and amplifying the signal from the detector, with the first circuit including an amplifier with a variable gain switch at its output for selectively adjusting the level of the signal produced by the detector to a desired not overly noisy level; a second circuit for allowing selection of a frequency band of best performance for the partition being monitored, with the second circuit including a band pass filter arrangement connected to receive the output signal from the variable gain switch to filter the signal from the variable gain switch with at least two selectable different pass bands, an AM detector circuit for detecting the peaks of a filtered output signal from the filter arrangement, and means for selectively enabling an output signal from the second circuit corresponding to a detected signal in one of the pass bands; and, a third circuit for processing the output signal from the second circuit to provide an alarm indicating the detection of vibrations representative of an intrusion attempt of the partition.

Preferably the detector comprises a length of shielded cable including at least one center conductor surrounded by a dielectric, and the first circuit is connected to one end of the cable and senses changes in the electric signal generated by the stressing of the cable dielectric due to flexing of same by movement of the partition and produces an electrical signal corresponding to the sensed electric signal.

Moreover, according to an important feature of the invention, the apparatus includes an LED bar display connected to monitor and display the enabled output signal from the second circuit in order to permit selection of a desired pass band, e.g., by applying a known stimulus to the detector and observing the response on the display with the various pass bands.

According to the preferred embodiment of the invention the band pass filter arrangement includes at least first and second band pass filters which each have a different pass band to cover a desired total band width, and which each receive the output signal from the variable gain switch as an input signal; the AM detector circuit includes a respective AM detector connected to the output of each band pass filter; the means for selectively causing an output signal from the second circuit includes respective shaping circuits for shaping the respective output signals from the AM detectors, and a switch arrangement for selectively enabling one of the shaping circuits; and the third circuit is connected to the output of each of the shaping circuits.

To provide protection of the structure or space containing the partition against intrusion by breaking, or cutting through, a partition, the third circuit includes a circuit device which produces an output signal whenever the enabled output signal of the second circuit has a duration less than a first predetermined short value, a counting circuit which counts the output signals from the circuit device and produces an output signal whenever the counting circuit reaches a predetermined count within a preset period of time, and an alarm circuit which produces an alarm in response to the output signal from the counting circuit.

In order to provide protection of the interior of a structure or of an area against intrusion by climbing over the partition, or through the ceiling or windows of the structure, or drilling through the walls, the system or apparatus, i.e., the third circuit, additionally includes a further circuit for providing an output signal whenever the enabled output signal of the second circuit has a duration greater than a first predetermined valued, and an additional circuit which is responsive to the output signal from this further circuit for causing an alarm if this further circuit means produces an output signal for a predetermined portion of a preset time period whose duration is greater than the first predetermined value.

In general, if the detected burst of signal is less than one second in duration, it is categorized as a cut type (short-term event) and a so-called cut counter is incremented. Otherwise, if the detected burst is greater than one second, the intrusion is categorized as of the climb type (sustained activity), and its duration is timed. It should further be noted that according to a further feature of the invention the count selector circuit used to count the short duration pulses indicative of a cut-through type intrusion only counts same if succeeding pulses are received within a selectable time duration which is adjustable, for example, from 8 to 128 seconds.

The invention thus allows for selection of the base frequency most representing a potential threat as well as avoiding frequencies of potential false alarms. Further, the selection of the duration of the same frequency, or repetitions of the same frequency over a specified window of time, allows for several means to select the event which is most likely to be a true alarm event.

Since it is possible for a knowledgeable intruder to compromise the system during non-monitoring periods by cutting, shorting, or attempting to replace the cable with non-reactive type cable, an arrangement is provided to prevent such tampering. In particular, a DC voltage is applied to the cable and at the end away from the sensing apparatus, a termination device is added. Thus if the cable is cut, shorted, or substituted, the apparatus senses the change in DC voltage level and initiates a tamper alarm.

DETAILED DESCRIPTION OF THE PREFERRED EMBODIMENTS

Figure 1:
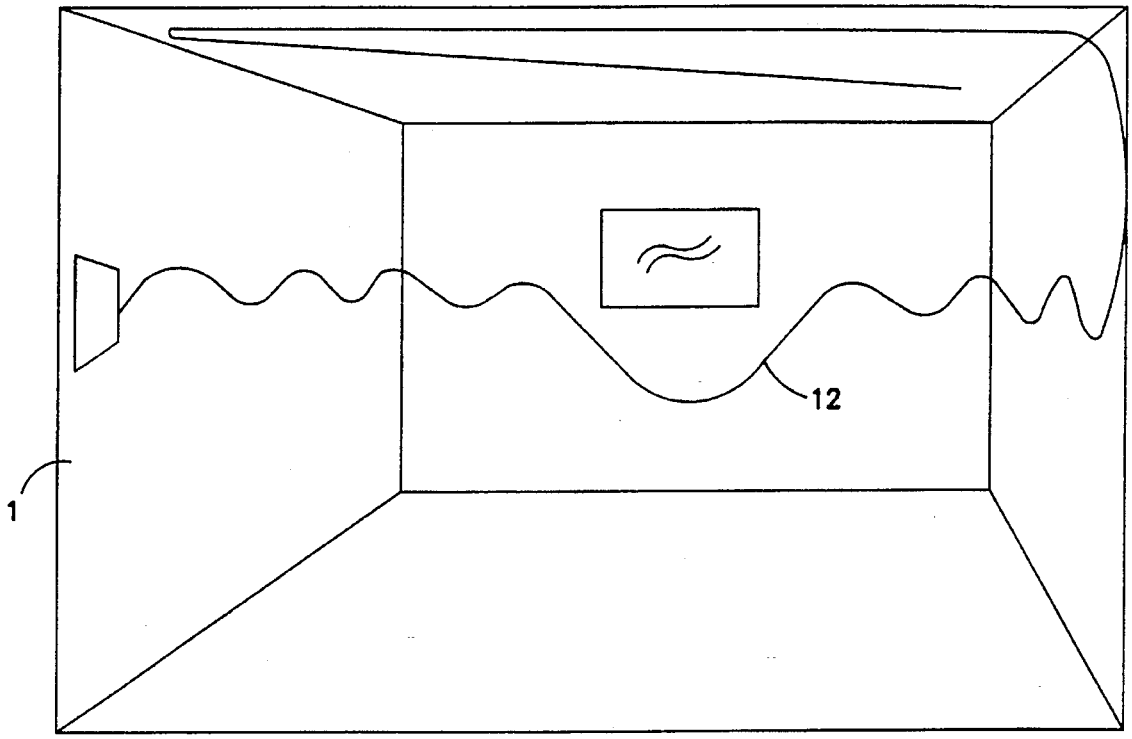
FIG. 1 is a schematic illustration showing a partition for an interior area having a shielded electrical cable mounted thereon for sensing vibrations of the partition walls and ceiling.

Referring now to FIG. 1 of the application, there is shown an interior wall 1 and ceiling of a room or area having a vibration sensor or detector 2, in particular a length of shielded cable, attached thereto in a suitable manner. It is to be understood that, although not shown, the partitions or wall 1 can extend completely around the perimeter of such an interior area to be protected and the length of the sensing cable utilized may be in the order of, or be as long as, 2000 feet. It is further noted that although the invention is primarily intended for walls (including ceilings and floors), it can likewise be used for fences, and other types of partitions such as, for example, grills, gratings, walkways, cable conduits, etc., whether indoors or out of doors. The vibration sensor 2 is fed to a detecting and processing circuit 3 which is shown in greater detail in FIG. 2.

Figure 2:
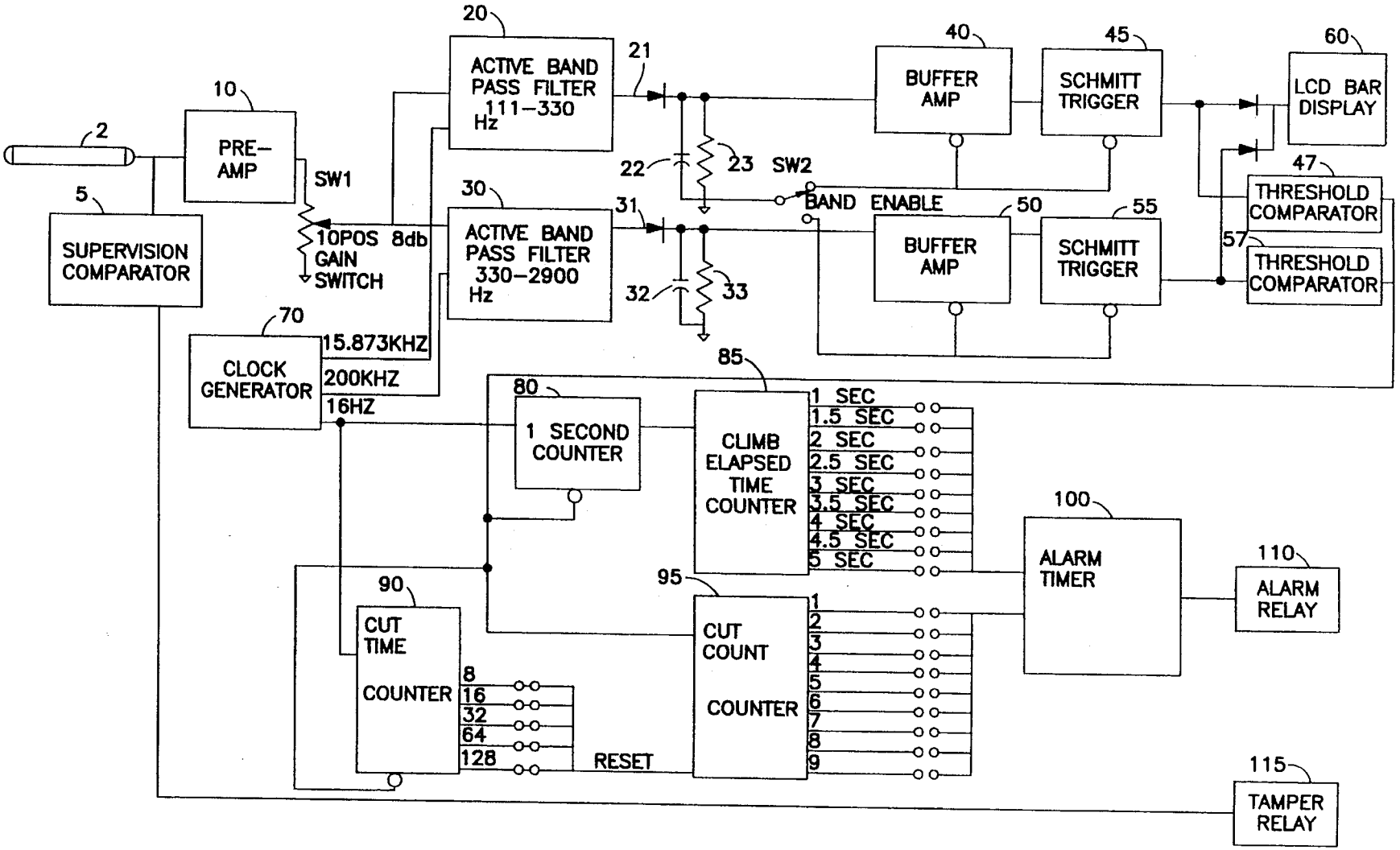
FIG. 2 is a block circuit diagram of an intrusion warning system for protecting a structure according to the invention.

Referring now to FIG. 2, the inner conductor of the sensor cable 2 attached to the walls 1 and/or ceiling, is fed to a circuit arrangement for sensing the electrical signal generated due to flexing of the cable 2 and for producing an electrical signal corresponding to same. The circuit for sensing the electric signal generally includes a preamplifier 10 which, in view of the very small signal produced by the cable 2, should be a high gain amplifier. Preferably, the preamplifier stage additionally has a high input impedance low leakage current input stage and is of the type disclosed in U.S. Pat. No. 3,956,743 issued May 11th, 1976 to T. D. Geiszler et al. The output signal from the preamplifier 10 is fed through a schematically shown step switch SW1, which serves as a sensitivity control to permit control over the amount of flexing or signal required to subsequently produce an alarm, to each of two active band pass filters 20 and 30. The switch SW1 preferably has ten positions each providing an equal increment in gain, for a total of 95.5 db.

To verify the integrity of the cable 2 against cuts, shorts or changes in resistive value, a dc voltage is applied to the center conductor of the cable 2 which is terminated at its end remote from the amplifier by a device (not shown) connected to the outer conductor or shield of the cable 2, and a circuit 5 detects and compares the dc voltage level on the conductor to a reference level, for example, 5 volts D.C. in the preferred embodiment. If the monitored level shifts more than ±10%, the circuit 5 produces an output causing a supervision alarm to be generated by deactivating a tamper relay 115. This relay 115 will also deactivate via the output signal from circuit 5, in a manner not shown, if power for the system is lost or in the case of battery operation, the input voltage drops below 10.19 vdc. To prevent oscillation of the relay 115, the comparator 5 is designed with hysteresis control so that it will not re-energize until the voltage has reached 10.3 volts.

The active band pass filters 20 and 30 are switched capacitor filters provided with band pass filtering arrangements which are preferably designed so that filter 20 passes frequencies between the cutoff frequencies of 110 Hz and 330 Hz, and filter 30 passes frequencies between the cutoff frequencies of 330 Hz and 2.9 kHz. The two pass bands provided by the filters 20 and 30 allow for selection of low frequencies for applications with intrusions producing low frequencies such as, but not limited to, breaking, or pressure collapse, and for selection of higher frequencies for applications when cutting, chipping, or tapping type intrusions are expected. The provision of the selectable bands provides additional advantages as will be evident below. Although only two band pass filters are indicated, more such filters with their associated circuitry for additional pass bands may be provided to cover a particular predetermined total frequency band.

The amplified and filtered AC electrical signals provided at the respective outputs of the filters 20 and 30 are then passed through respective AM detectors including a diode 21, a capacitor 22, and a resistor 23, or a diode 31, a capacitor 32 and a resistor 33, respectively. Each AM detector circuit 21–23 and 31–33 is dimensioned so that it is essentially a fast rise, slow decay detector and essentially raises the peaks of the signal corresponding to the vibration activity.

The output signals from the detectors 21–23 and 31–33 are passed through respective shaping circuits, including unity gain buffer amplifiers 40 and 50 and respective Schmitt triggers 45 and 55 in order to produce definitive high-low signals from the signals produced by the respective AM detectors. The output signal produced by the Schmitt trigger 45 or 55 respectively is in the form of a positive pulse. A band enable switch SW2, depending on its position, enables the buffer amplifier 40 or 50 and the respective Schmitt trigger circuit 45 or 55 for the frequency band desired by the operator. The other amplifier-Schmitt trigger circuit is disabled, i.e. buffer amplifier 40 and Schmitt trigger 45 are enabled only during low frequency operation and buffer amplifier 50 and Schmitt trigger 55 are enabled only during high frequency operation.

The output signal from the selected Schmitt trigger 45 or 55 is fed to an LED bar display circuit 60 for operator evaluation of the input level produced from a typical vibration generated during setup with a test apparatus used to simulate intrusion events. An LED bar driver device included in the circuit 60 is used to convert the analog level produced by the output of either of the AM detectors and appearing at the output of Schmitt trigger 45 or 55 into digital levels corresponding to the ten LED segments. To conserve power, the LED's themselves may be disabled, when not desired, by a switch (not shown).

To select the desired position of the band enable switch SW2 after installation of the system, the detector or cable 2 is subjected to known vibration causing stimulii and the signal produced at the output of the Schmitt trigger 45 or 55 is observed on the display 60. By observing the response with the switch SW2 in each position, the band pass which produces the best result for monitoring purposes may be selected by the operator. The display 60 may also be used to set the gain switch SW1 to a desired value in a simple manner.

The outputs of the Schmitt triggers 45 and 55 are fed to respective over-voltage threshold comparator (hereinafter OVT) circuits 47 and 57, where the output signal of the enabled Schmitt trigger 45 or 55 is compared to see if it exceeds factory set limits.

A clock generator 70 is used to create various frequency clocks used in the band pass filters 20 and 30 as well as a 16 hz clock used to time the output from the selected or enabled OVT circuit 47 or 57 which exceeds the threshold.

In the case where a vibration of long duration above the threshold occurs, a one-second timer 80 is enabled by the output of the selected OVT circuit 47 or 57 and clocked with the 16 hz clock generated by circuit 70. If this counter 80 counts for 1 second without the selected OVT output signal dropping below the threshold, a so-called climb (or sustained activity) elapsed time counter 85 is activated or unlatched to begin counting the 16 Hz clock pulses appearing at the output of counter 80 to provide output signals at preset intervals on respective outputs as shown. In the illustrated embodiment the counter is a one-half second counter which provides an output at a first output terminal upon being activated and at successive one-half second intervals thereafter. The elapsed time interval for this counter 85 to produce an output signal to an alarm timer 100 is selectable by an operator by completing the connection between one of the output terminals of counter 85 and the input to the timer 100. If the operator selected desired interval, e.g., 1 sec to 5 sec in 0.5 sec increments as indicated, is exceeded, the output signal of counter 85 will trigger an alarm via timer 100 and alarm relay 110.

In the case where a vibration of short duration above the threshold occurs in the selected OVT circuit 47 or 57, the so-called cut (or short term event) time counter 90 is enabled to begin to count elapsed time from this initial vibration by counting the 16 Hz clock pulses. The operator selects the time interval from 8 to 128 total seconds, as indicated, in which this counter 90 allows a cut counter 95 to count subsequent vibrations. The cut counter 95 counts the number of short vibrations above the threshold and upon reaching an operator selected quantity between 1 and 9 as indicated, cause an alarm to be generated via timer 100 and relay 110. If the count selected for the counter 95 is not reached within the interval selected by the operator for the cut time counter 90, the cut counter 95 is reset without generating an alarm.

Although the invention as described preferably uses a coaxial electrically shielded cable as the vibration detector, it is to be understood that other types of vibration sensitive detectors, for example, piezoelectric or fiberoptic cables, which have the required vibration sensitivity likewise may be used.

The invention now being fully described, it will be apparent to one of ordinary skill in the art that many changes and modifications can be made thereto without departing from the spirit or scope of the invention as set forth herein.

We claim:

1. Apparatus for detecting intrusion of a partition, comprising:

a detector means, attachable to the partition to be protected, for detecting vibrations of the partition and for providing a signal corresponding thereto;

first circuit means for receiving and amplifying said signal from said detector means, said first circuit means including an amplifier for amplifying said signal and a variable gain switch, connected to an output of said amplifier, for selectively adjusting the level of the signal produced by said detector means to a predetermined level;

second circuit means for selection of a predetermined frequency band for the partition being monitored, said second circuit means including band pass filter means, connected to receive an output signal from said variable gain switch, for filtering said output signal from said variable gain switch with at least two different pass bands, AM detector means for detecting the peaks of a filtered output signal from said filter means, and means for selectively causing an output signal from said second circuit means corresponding to an output signal from said AM detector means in only one of said pass bands; and third circuit means for processing the output signal from said second circuit means to provide an alarm indicating the detection of vibrations representative of an intrusion attempt of the partition.

2. Apparatus as defined in claim 1 further comprising LED bar display means for monitoring and displaying the output signal from said second circuit means.

3. Apparatus as defined in claim 1 wherein: said band pass fliter means includes at least firt and second band pass filters, each of said band pass filters having a different one of said pass bands at least two to cover a desired total band width, and with each of said band pass filters receiving said output signal from said variable gain switch as an input signal; said AM detector means includes a respective AM detector connected to the output of each of said band pass filters; said third circuit means includes respective shaping circuits for shaping respective output signals from each said AM detector, and switch means for selectively enabling one of said shaping circuits; and said third circuit means is connected to the output of each of said shaping circuits.

4. Apparatus as defined in claim 3 wherein: said detector means comprises a length of shielded cable including at least one center conductor surrounded by a dielectric; and said first circuit means includes means, connected to one end of said cable, for sensing changes in the electric field signal generated by the stressing of said cable dielectric due to flexing of same by movement of the partition and for producing an electrical signal corresponding to the sensed electrical signal.

5. Apparatus as defined in claim 4 further comprising LED bar display circuit connected to the output of each of said shaping circuits.

6. Apparatus as defined in claim 4 wherein said third circuit means includes fourth circuit means for producing an output signal in response to the output signal of the enabled one of said shaping circuits having a duration less than a first predetermined short value, a counting circuit means for counting output signals produced by said fourth circuit means and for producing an output signal in response to said counting circuit means reaching a predetermined count within a preset period of time, and an alarm circuit for producing an alarm signal in response to said output signal from said counting circuit means, whereby protection against intrusion by breaking through the partition to be protected is provided.

7. Apparatus as defined in claim 6, wherein said third circuit means includes: fifth circuit means for providing an output signal whenever the output signal of the enabled one of said shaping circuits has a duration greater than said first predetermined value, and an additional circuit means responsive to the output signal from said fifth circuit means and being in communication with said alarm circuit such that said alarm circuit produces an alarm signal when said fifth circuit means produces an output signal for a predetermined portion of a preset time period, whereby intrusion by sustained activity events aimed at breaching the partition can be determined.

8. Apparatus as defined in claim 4 further comprising means for monitoring a dc voltage level on said cable and for producing a tamper alarm when said level differs by a preset amount from a reference value.

9. A method of selecting a frequency band using the apparatus of claim 5, the method comprising the steps of:

(a) applying a predetermined stimulus to said cable;

(b) observing the indication on said bar display while each of said shaping circuits is selectively enabled; and (c) selecting and enabling the one of said shaping circuits which produces the highest level output on the bar display; and (d) enabling the pass band associated with said selected and enabled shaping circuit, whereby said frequency band is selected.

10. The method as defined in claim 9 further comprising the step of setting said variable gain switch while observing said bar display to provide a predetermined gain.

* * * * *